United States Patent [19]

Roeder et al.

[11] 4,434,935

[45] Mar. 6, 1984

[54] POWDER, ESPECIALLY METALLIC POWDER FOR MARKING WORKPIECES

[75] Inventors: Georg Roeder; Helmut Sachs, both of Frankfurt am Main; Dieter Hajok, Hattersheim, all of Fed. Rep. of Germany

[73] Assignee: Messer Griesheim GmbH, Frankfurt, Fed. Rep. of Germany

[21] Appl. No.: 29,357

[22] Filed: Apr. 11, 1979

[30] Foreign Application Priority Data

Apr. 29, 1978 [DE] Fed. Rep. of Germany ..... 2819091

[51] Int. Cl.[3] ..... B05B 7/32

[52] U.S. Cl. ..... 239/85; 239/143

[58] Field of Search ..... 239/143, 654, 302, 325, 239/346, 373, 79, 85; 222/195; 406/136, 137, 146; 75/251, 255

[56] References Cited

U.S. PATENT DOCUMENTS

| | | | |
|---|---|---|---|
| 3,407,057 | 10/1968 | Timmons | 75/251 |
| 3,501,097 | 3/1970 | Daley | 239/85 |
| 3,617,358 | 11/1971 | Dittrich | 75/251 X |
| 3,655,425 | 4/1972 | Longo | 75/251 |
| 3,722,818 | 3/1973 | Hayasaki et al. | 239/85 |

FOREIGN PATENT DOCUMENTS

| | | | |
|---|---|---|---|
| 425449 | 3/1935 | United Kingdom | 239/85 |

*Primary Examiner*—John J. Love

*Attorney, Agent, or Firm*—Connolly and Hutz

[57] ABSTRACT

Powder, such as metallic powder for marking workpieces, consists of a blend of fine powder and of coarse powder.

7 Claims, 1 Drawing Figure

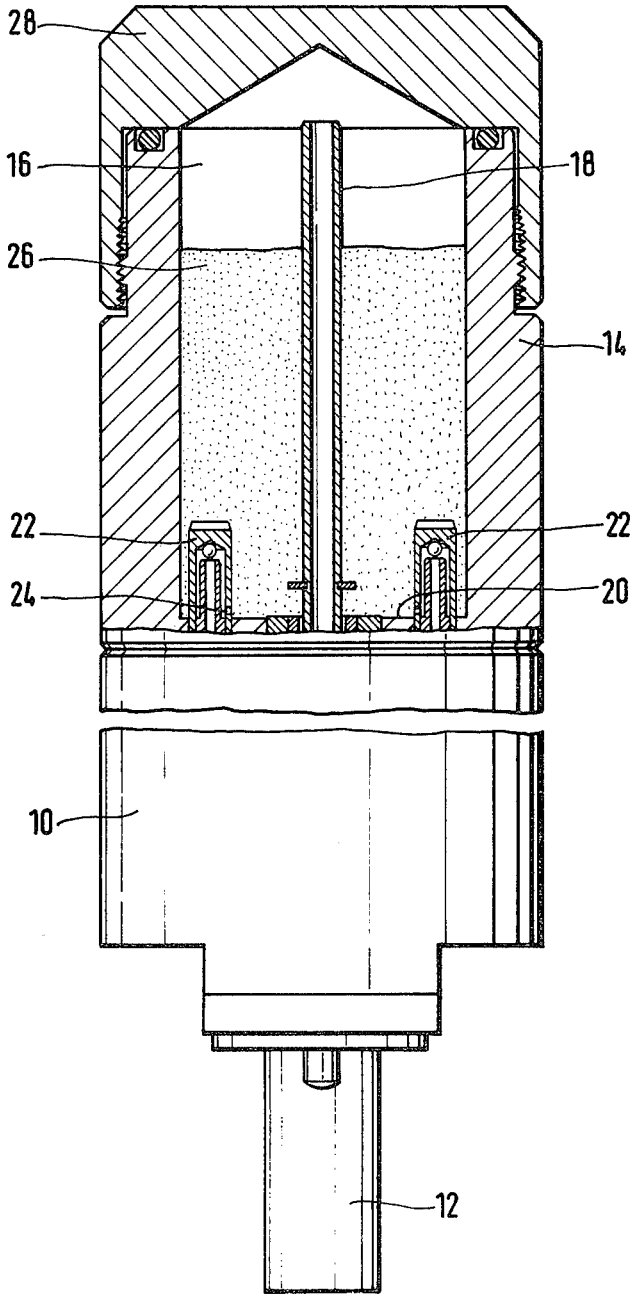
28
16
18
26
14
22
22
24
20
10
12

POWDER, ESPECIALLY METALLIC POWDER FOR MARKING WORKPIECES

BACKGROUND OF INVENTION

The invention is concerned with a powder, especially a metallic powder for marking workpieces.

Metallic powders which are applied to a workpiece by means of a marking nozzle in order to mark it for later processing are known to the overall state of the art. The metallic powders used up to now are very fine, that is, flour-like and have a particle size of about 3–10μ. Since, in the case of this flour-like metallic flour dust, the individual particles are directly against one another, there results, in large measure, an agglomeration. This has, however, the disadvantage that the transport of the flour-like powder from a supply bin to the marking nozzle by means of oxygen occurs in a very erratic manner. Beyond this it is required to work with high oxygen pressure (2–3 bar).

The erratic transport of the metallic powder caused by the agglomeration has a further disadvantageous influence upon the line to be produced on the surface of a workpiece with regard to the line's width and thickness. Because of the lack of continuity, it can happen during the marking process that, suddenly, too much metallic powder comes out of the marking nozzle, which then burns in the heating flames surrounding the stream of metallic powder. An undesirable formation of smoke which contaminates the environment results.

SUMMARY OF INVENTION

It is therefore the object of the present invention to achieve a powder, especially a metallic powder for marking workpieces with which no agglomeration occurs and as a result, a continuous flow of metallic powder from the supply bin, through the marking nozzle and from the latter onto the surface of the workpiece takes place.

In order to accomplish this object, it is proposed, according to the invention, that the powder consist of a mixture of fine and course powders.

According to the preferred form of the embodiment of the invention, it is provided that the fine powder has a particle size of 1–10μ, preferably 2–6μ and that the coarse powder has a particle size of 30–80μ, preferably 40–60μ.

The inventive powder is furthermore characterized, in an advantageous fashion, by a blend ratio of fine to coarse powder of 1:3 to 1:6.

As a result of the previously defined inventive metallic powder, its flow capability and therewith its continuous application onto the workpiece is assured. As a result of the inventive metallic powder blend, good marking results on the surface of the workpiece are attained whereby the quality of the applied marking line remains the same, (that is, line width and thickness) as at the beginning of the marking process, even after a prolonged marking process.

THE DRAWING

The single FIGURE shows an elevation view partly in section of a marking torch utilizing the inventive powder.

DETAILED DESCRIPTION

In the drawing, a marking device 10 is represented, at the lower end of which a nozzle 12 is attached. The other end of the marking device 10 holds a powder container or vessel 14 in the inner space 16 of which a tube 18 opens, the other end of which reaches into the nozzle 12.

As is further evident, swirl nozzles or agitating means 22 are mounted at the bottom of the powder vessel 14. In the case of the marking device represented in the drawing, three swirl nozzles are provided, which are arranged in a concentric circle about the tube 18 and at the distance of 120° from one another. Each of the nozzles has an opening 24 from which oxygen or another carrier gas flows into the inner space 16. The oxygen is channeled to the swirl nozzles from the lower region of the marking device 10 via lines which are not illustrated.

The upper end of the powder vessel 14 which serves to take up the inventive metallic powder 26 is sealed gas tight with a cover 28.

The inventive metallic powder, preferably a zinc powder, consists of a mixture of a fine powder and a coarse powder. The coarse powder portion has a particle size of 30–80μ, preferably 40–60μ, whereas the particle size of the fine powder portion lies between 1–10μ, preferably between 2–6μ.

The portions of fine and coarse powders are mixed with one another in a ratio of 1:3 to 1:6 to form the marking powder.

Only the fine powder (particle size 1–10μ) takes part in the marking process. But if one were to place only powder of this particle size, in other words, fine powder into the powder vessel, this powder would agglomerate as explained in the background of the invention as to the state of the art. In order to prevent this, the fine powder which effects the marking process is mixed, according to the invention, with coarse powder. The coarse powder, the individual particles of which are spherical, generally prevents an agglomeration. In the structural make-up of the fine-coarse powder blend, the fine powder settles in the cavities formed between the particles of the coarse powder. This coarse powder which does not agglomerate, serves as a spacer for the fine powder so that, because of the distance of the individual particles of fine powder from one another, an agglomeration of the latter is prevented. An eventually yet possible microagglomeration practically does not take effect.

Now, when oxygen which is used as a carrier gas is blown into the powder vessel 14 from the swirl nozzles 22, the inventive metallic powder blend is made to bubble. The fine powder which is capable of soaring is thereby "blown out" of its cavities which were formed by the particles of coarse powder; a type of wash-out of the coarse powder thus takes place. The fine powder particles which separate from the coarse powder now wander upward within the powder batch into the free region of the inner space 16 and there, together with the carrier gas which transports them, they form a type of mist.

As a result of the overpressure present in the powder cup, the mist type fine powder—oxygen mixture is pushed into the tube 18 and flows in the latter up to the nozzle 12 from which the fine powder then comes out.

As mentioned, the coarse powder operates only as a type of "spacer" for the fine powder for the purpose of preventing its agglomeration, but on account of its heavier weight, it is not pulled along by the carrier gas and does not, therefore, take part in the marking process.

After a certain marking time, the line produced on the workpiece by the fine powder becomes gradually paler, which is an indication for the attendant that the fine powder portion in the inventive metallic powder mixture is running low. The washed out coarse powder portion remaining in the powder cup 14 and which does not take part in the marking process, can be used again. It is hereby only required to again add powder with the specified particle size in a blend ratio of 1:3 to 1:6 and to mix these powders well.

What is claimed is:

1. In combination therewith a marking torch, said marking torch having a nozzle, a container, powder in said container, a tube connecting said nozzle to said container, agitating means in said container, carrier gas means communicating with said container, said powder consisting of a blend of fine powder and of coarse powder, said coarse powder functioning to prevent said fine powder from agglomerating, said coarse powder having a particle size of 30–80$\mu$, said fine powder having a particle size of 1–10$\mu$, said fine powder being of a size and weight to be carried by the carrier gas from said container and through said nozzle for marking the workpiece to comprise the sole powder marking means of said torch, and said coarse powder being of a size and weight to be unaffected by the carrier gas and to remain in said container without being conveyed to said nozzle to function solely as a means for preventing agglomeration.

2. The combination according to claim 1, characterized therein that said agitating means comprises a swirl nozzle having a plurality of individual spaced nozzles located within said powder for agitating said powder when said carrier gas flows through said agitating means to cause said fine powder to become mixed with said carrier gas and then flow through said tube.

3. The combination according to claim 1, characterized therein that said powder is metallic.

4. The combination according to claim 3, characterized therein that said fine powder has a particle size of 2–6$\mu$, and said coarse powder having a particle size of 40–60$\mu$.

5. The combination according to claim 4, characterized by a blend ratio of fine powder to coarse powder of 1:3 to 1:6.

6. The combination according to claim 5, characterized therein that said metallic powder is a zinc powder.

7. The combination according to claim 5, characterized therein that said fine powder has a pure zinc content of at least 97.5%.

* * * * *